US007018304B2

(12) United States Patent
Bradford

(10) Patent No.: US 7,018,304 B2
(45) Date of Patent: Mar. 28, 2006

(54) PUTTER HEAD

(76) Inventor: Brent W. Bradford, 19742 Azurefield, Newhall, CA (US) 91321

( * ) Notice: Subject to any disclaimer, the term of this patent is extended or adjusted under 35 U.S.C. 154(b) by 0 days.

(21) Appl. No.: 10/849,002

(22) Filed: May 20, 2004

(65) Prior Publication Data

US 2005/0261080 A1 Nov. 24, 2005

(51) Int. Cl.
*A63B 53/04* (2006.01)

(52) U.S. Cl. ..... 473/334; 473/340; 473/341; 473/336

(58) Field of Classification Search ..... 473/334–339, 473/340–341, 328, 251–255; D21/736–746
See application file for complete search history.

(56) References Cited

U.S. PATENT DOCUMENTS

| | | | | | |
|---|---|---|---|---|---|
| 3,240,497 | A | | 3/1966 | Taylor | |
| D223,676 | S | | 5/1972 | Meth et al. | |
| D229,844 | S | * | 1/1974 | Pavelle | D21/741 |
| 3,921,984 | A | * | 11/1975 | Winter | 473/251 |
| 4,010,958 | A | * | 3/1977 | Long | 473/341 |
| 4,138,117 | A | * | 2/1979 | Dalton | 473/255 |
| 4,871,174 | A | * | 10/1989 | Kobayashi | 473/252 |
| 5,197,737 | A | * | 3/1993 | Desbiolles et al. | 473/341 |
| 5,211,401 | A | | 5/1993 | Hainey | |
| 5,294,122 | A | | 3/1994 | Longo | |
| 5,344,149 | A | | 9/1994 | Miller | |
| 5,409,219 | A | * | 4/1995 | Saksun, Sr. | 473/305 |
| 5,417,429 | A | * | 5/1995 | Strand | 473/251 |
| D359,330 | S | * | 6/1995 | Channell | D21/741 |
| 5,429,356 | A | * | 7/1995 | Dingle et al. | 473/251 |
| 5,533,725 | A | | 7/1996 | Reynolds, Jr. | |
| 5,580,058 | A | | 12/1996 | Coughlin | |
| 5,769,736 | A | * | 6/1998 | Sato | 473/335 |
| 5,769,738 | A | | 6/1998 | Kershaw et al. | |
| 5,830,078 | A | * | 11/1998 | McMahan | 473/252 |
| 5,947,841 | A | | 9/1999 | Silvestro | |
| 6,019,686 | A | | 2/2000 | Gray | |
| 6,120,389 | A | | 9/2000 | Kruse | |
| 6,267,689 | B1 | | 7/2001 | Ambrose | |
| 6,383,089 | B1 | | 5/2002 | Bonneau | |
| 6,435,979 | B1 | | 8/2002 | Mounfield, Jr. | |
| 6,454,663 | B1 | | 9/2002 | Bakke | |
| 6,464,599 | B1 | | 10/2002 | Wolf | |
| 6,488,595 | B1 | * | 12/2002 | Grace | 473/341 |
| 6,652,390 | B1 | * | 11/2003 | Bradford | 473/341 |
| 2002/0193176 | A1 | | 12/2002 | Grace | |
| 2003/0083149 | A1 | | 5/2003 | Scarpa et al. | |
| 2003/0144077 | A1 | | 7/2003 | Cullen | |

* cited by examiner

*Primary Examiner*—Sebastiano Passaniti
(74) *Attorney, Agent, or Firm*—Welsh & Flaxman

(57) ABSTRACT

A golf putter head includes a primary body member having a striking face with a toe end and a heel end, a top surface and sole. The primary body member includes a toe wing extending back and away from the toe end of the striking face and a heel wing extending back and away from the heel end of the striking. The golf putter head also includes a first weight member extending from the toe wing and a second weight member extending from the heel wing.

16 Claims, 2 Drawing Sheets

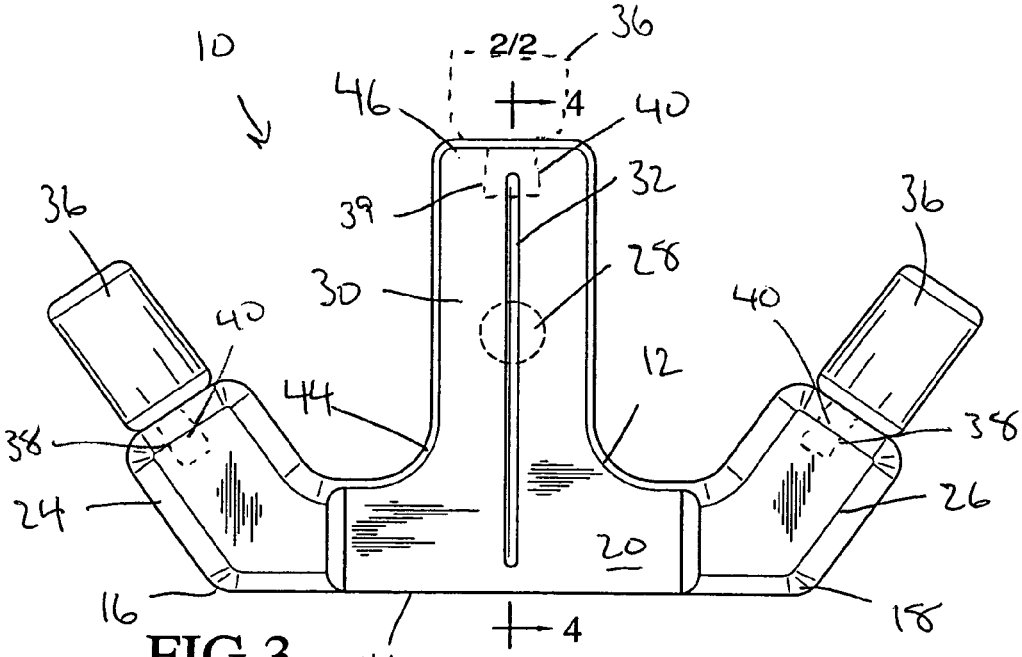
FIG.3
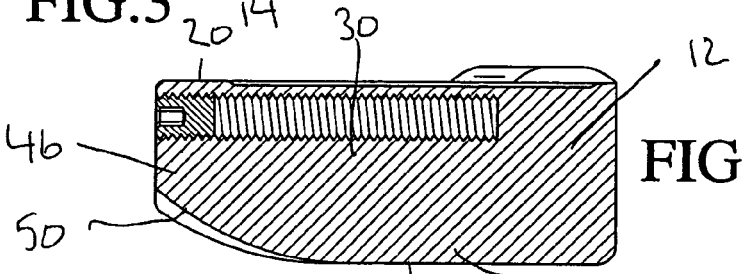
FIG.4
FIG.5
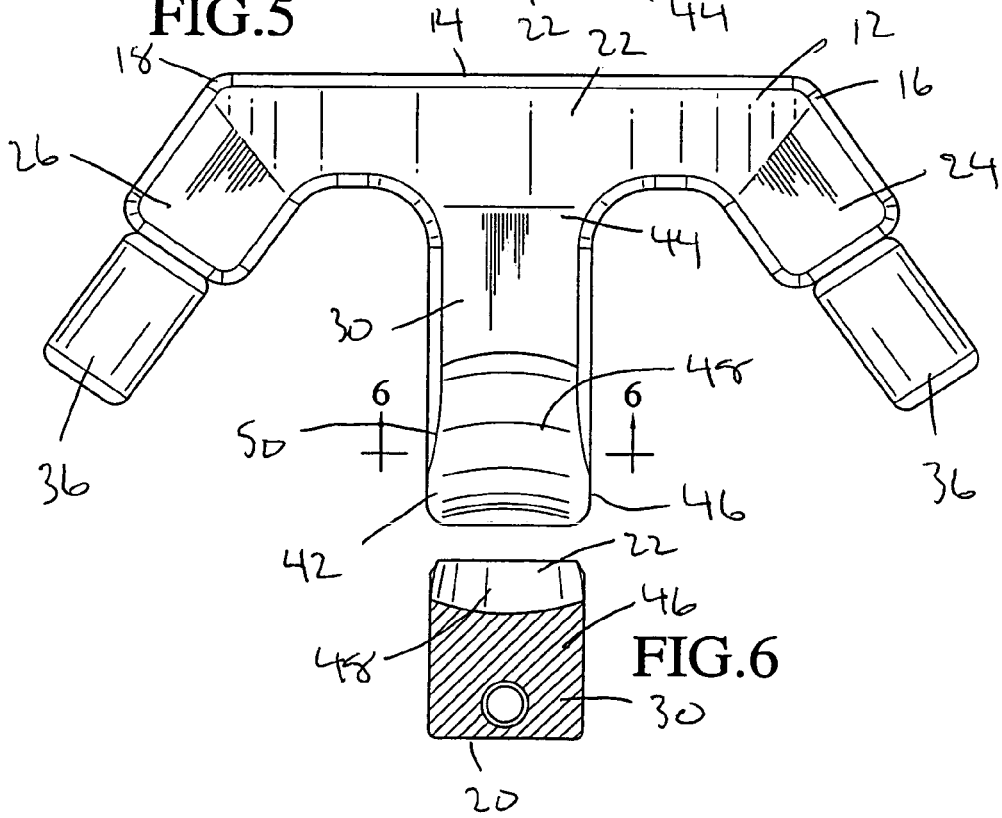
FIG.6

PUTTER HEAD

BACKGROUND OF THE INVENTION

1. Field of the Invention

The invention relates to a putter head for playing the game of golf. More particularly, the invention relates to a putter head having substantial mass shifted to the heel and toe of the putter head and shifted above a horizontal center plane of the putter head.

2. Description of the Prior Art

Putters generally fall into two categories: mallet-style putter heads and blade-style putter heads. Mallet-style putter heads have a relatively large, solid head that is often semicircular in shape when viewed from above, while blade-style putter heads have a relatively narrow or blade-like head. Each type of putter includes a generally flat strike face for hitting the golf ball. Accuracy of a putt depends upon where the striking face impacts the ball, as well as on the orientation of the striking face at impact. Accuracy also depends on hitting the ball at a central area of the striking face, known in the art as the "sweet spot." Generally, control of the direction of travel of the golf ball, and the distance traveled, decreases with the increase in distance away from the sweet spot from which the ball is struck However, the effective hitting area or sweet spot may be expanded by appropriately weighting the putter head. Weighting may also be used to improve the feel and stability of the putter head during the putting stroke.

The balance, weight and moment of inertia of a putter plays an important role in the effectiveness of the club. As such, it is desirable to increase the effective striking area while maintaining a high moment of inertia and reduce the effect of torque created from an off-center golf stroke.

Traditional de-weighting processes involve removing exterior weight from the putter head. With this design, the hosel is typically located at the end of the club head. More recently, putter head manufacturers have removed the weight from the interior of the putter head. Once the heavier material is eliminated, a solid insert of lower density material connects to the head and creates a new striking surface.

Many golf putter designs have attempted to maximize the sweet spot provided by a golf club. However, a need continues to exist for a putter head to provide a center of gravity moved rearward and upwardly relative to the striking face. The present invention provides a putter head with the majority of the putter head mass moved to the tips of the "wings." The present invention also provides a putter head with the majority of the putter head mass positioned above a horizontal center plane.

SUMMARY OF THE INVENTION

It is, therefore, an object of the present invention to provide a golf putter head including a primary body member having a striking face with a toe end and a heel end, a top surface and sole. The primary body member includes a toe wing extending back and away from the toe end of the striking face and a heel wing extending back and away from the heel end of the striking face. The golf putter head also includes a first weight member extending from the toe wing and a second weight member extending from the heel wing.

It is also an object of the present invention to provide a golf putter head wherein the primary body member further includes a central wing extending rearwardly from a center of the striking face between the heel end and the toe end, and the central wing includes a first end adjacent to the striking face and a free second end extending away from the striking face.

It is another object of the present invention to provide a golf putter head wherein a third weight member extends or is continued from the second end of the central wing.

It is a further object of the present invention to provide a golf putter head wherein the first, second and third weight members are selectively coupled to the primary body member.

It is also another object of the present invention to provide a golf putter head wherein the first weight member and the second weight member are made from a material having a higher density than the primary body member.

It is yet a further object of the present invention to provide a golf putter head wherein the sole adjacent the second end of the central wing is contoured with both concave and convex surfaces.

It is also an object of the present invention to provide a golf putter head wherein sole adjacent the second end of the central wing has a radius of curvature as the central wing extends rearwardly creating a convex surface.

It is still another object of the present invention to provide a golf putter head wherein the sole adjacent the second end of the central wing has a concave surface which extends laterally across the central wing along the convex surface.

It is a further object of the present invention to provide a golf putter head wherein the first and second weight members are selectively coupled to the primary body member.

It is another object of the present invention to provide a golf putter head wherein the putter body includes a horizontal central plane, the horizontal central plane is considered to be a horizontal plane extending through the putter body and equal distance from both an uppermost surface of the upper surface of the primary body member and a lowermost surface of the sole, wherein the first and second weight members are coupled to the primary body member such that a majority of their mass is positioned above the horizontal center line.

It is also an object of the present invention to provide a golf putter head wherein at least approximately 70% of the total putter head mass is positioned above the horizontal center plane.

It is still a further object of the present invention to provide a golf putter head wherein between approximately 55% and approximately 75% of the total putter head mass is positioned above the horizontal center plane.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 3 is a top view of the putter head.

FIG. 4 is a cross sectional view taken along the line 4–4 of FIG. 3.

FIG. 5 is a bottom view of the putter of the putter head.

FIG. 6 is a cross sectional view taken along the line 6–6 of FIG. 5.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
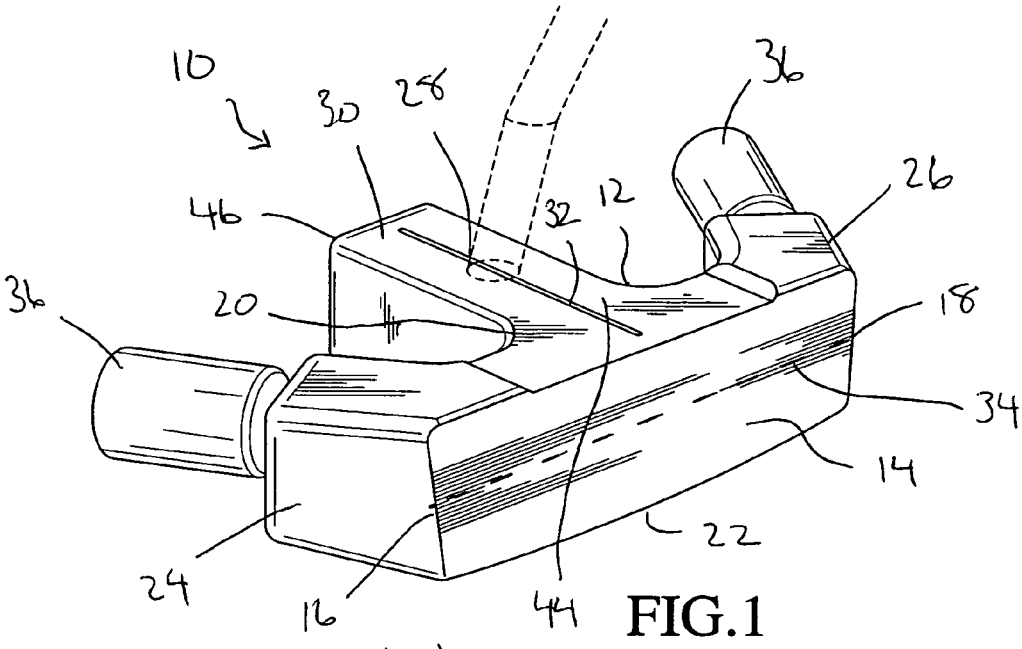
FIG. 1 is a front perspective view of the putter head in accordance with the present invention.
Figure 2:
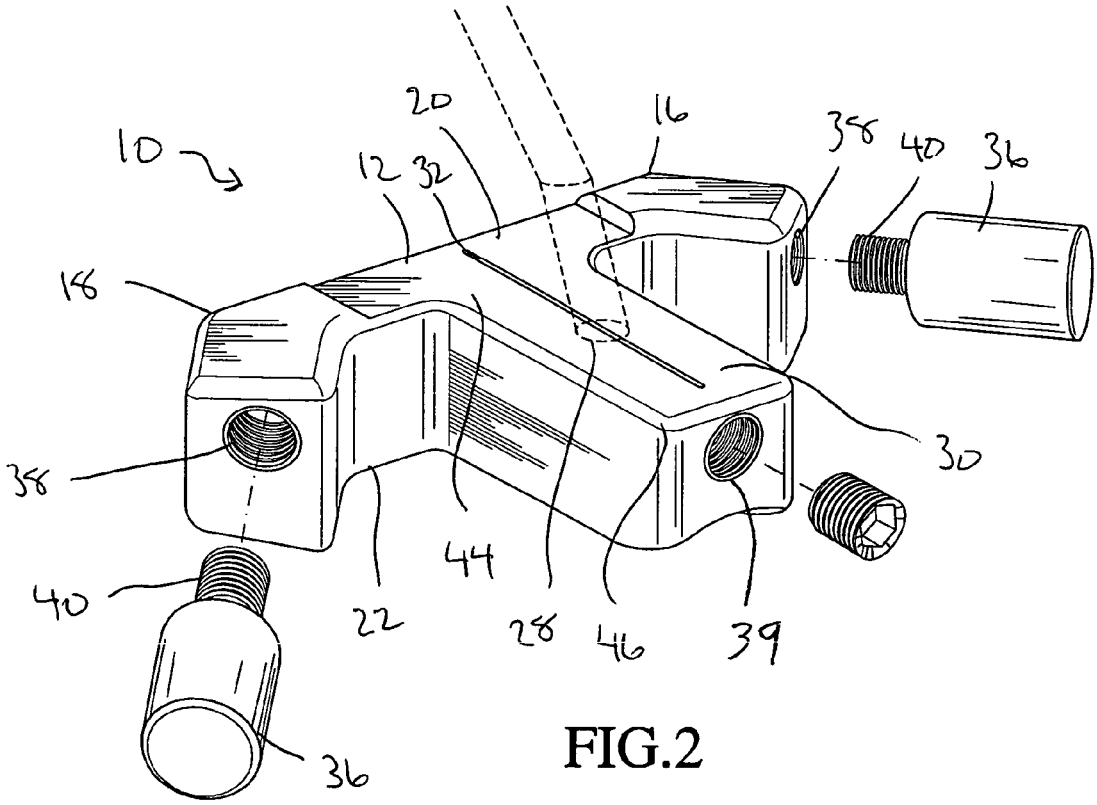
FIG. 2 is a rear perspective view of the putter head.

With reference to FIGS. 1 to 6, a golf putter head 10 is shown. The putter head 10 includes a primary body member 12 having a "winged" configuration. The primary body member 12 of the putter head 10 includes a forward facing striking face 14 with a toe end 16 and a heel end 18, a top surface 20 and a sole 22. The primary body member 12 also includes a toe wing 24 and heel wing 26 which extend back from the respective toe end 16 and the heel end 18 of the striking face 14. The toe wing 24 and heel wing 26 extend rearwardly at an oblique angle from the striking face 14 beyond the toe end 16 and the heel end 18. As will be discussed below in greater detail, the toe and heel wings 24, 26 add weight which moves the center of gravity (CG) rearwardly from the striking face 14. The putter head 10 includes a shaft connection 28 for attachment of a traditional golf club shaft thereto.

The putter head 10 also includes a rearwardly oriented central wing 30 extending directly from the central portion of the striking face 14. The central wing 30 is aligned with the center of the putter head 10 and is, therefore, positioned equal distances from the respective toe and heel wings 24, 26. As with the toe and heel wings 24, 26, the central wing 30 moves the center of gravity rearwardly away from the striking face 14. As such, the central wing 30 represents the third weight employed in the creation of the directional, top spread heel and toe weighting.

In addition to shifting the center of gravity, the central wing 30 provides a visual indicator along the line through which the putter head 10 should move while putting a golf ball. The functionality is further enhanced by the provision of an alignment marking 32 along the top surface of the central wing 30. The alignment marking 32 is oriented perpendicularly to the striking face 14 and is positioned at the center of the striking face 14 where one should strike a golf ball while putting.

In accordance with a preferred embodiment of the present invention, the primary body member 12 is made of aluminum. However, and as those skilled in the art will certainly appreciate, other materials may be used without departing from the spirit of the present invention.

In addition to shifting mass rearwardly in an effort to move the center of gravity rearwardly to enhance the functionality of the present putter head 10, the mass of the putter head 10 is shifted above the horizontal center plane 34 of the primary body member 12. The horizontal center plane 34 of the putter head 10 is considered to be a horizontal plane extending through the putter head 10 as it lies on a putting surface. The horizontal center plane 34 is positioned equal distances from both the uppermost surface of the primary body member 12 and lowermost surface of the primary body member 12.

By shifting the weighting above the horizontal center plane 34 of the primary body member 12, the force applied by the putter head 10 upon striking a golf ball promotes greater and more immediate top spin when a golf ball is struck This is achieved by increasing the angular momentum imparted to the struck golf ball. By shifting the mass of the putter head 10 upward, and thereby lifting the center of gravity upward, the center of gravity will be at or above the center line of the struck golf ball, thereby avoiding undesirable lifting or rising of the golf ball upon impact.

This shift in weight is achieved by securing high density weight members to the free ends of the toe and heel wings 24, 26 at a position such that the majority of the weight members 36 are above the horizontal center plane 34 of the primary body member 12. In accordance with a preferred embodiment of the present invention, the weight members 36 are formed of a tungsten/copper composite or pure tungsten. However, those skilled in the art will appreciate that the weight members may be formed from a variety of other high density materials without departing from the spirit of the present invention.

In accordance with a preferred embodiment of the present invention, each of the weight members 36 includes a central longitudinal axis and the axis, when the respective weighting members 36 are secured to the toe and heel wings, extends through the primary body member 12 at a position between the horizontal center plane 34 and the uppermost surface of the primary body member 12. In this way, the majority of the weight attributed to the weight members 36 is positioned above the horizontal center plane 34, shifting the majority of the mass of the putter head 10 above the horizontal center plane 34.

The versatility of the present putter head 10 is further enhanced by providing the weight members 36 such that they are selectively removable from the toe and heel wings 24, 26 of the primary body member 12. More specifically, each of the toe and heel wings 24, 26 are formed with threaded recesses 38 shaped and dimensioned for receipt of a threaded post 40 extending from each of the weight members 36. As such, the weight members 36 may be selectively screwed into and out of the threaded recesses 38 formed in each of the wings 24, 26 for attachment of various weight members 36 (of various weights) depending upon the needs and desires of individual golfers.

Although the weight members 36 are disclosed as being cylindrical bodies attached to the free ends of the toe and heel wings 24, 26 using a threaded attachment mechanism, other shapes, attachment structures and orientations may be employed without departing from the spirit of the present invention.

The second end 46 of the central wing 30 is similarly provided with a threaded recess 39 shaped and dimensioned for receipt of the threaded post 40 extending from the weight members 36. A such, greater versatility is provided as the weight members may be selectively secured in any combination to the three wings.

In accordance with a preferred embodiment of the present invention, the mass of the putter head 10 is shifted such that at least approximately 55% to 75% of the putter head mass is located above the horizontal center plane 34. More preferably, at least 70% of the total putter head mass is positioned above the horizontal center plane 34.

The putter head 10 is further provided with a unique sole structure 22 helping the golfer move the putter head 10 along the ground as he or she prepares to stroke a putt. In particular, the sole 22 of the putter head 10 is curved as it extends from the toe to the heel with the lowermost point of the sole 22 being substantially aligned with a central position between the heel end 18 and toe end 16 of the striking face 14. In particular, the sole has a radius of curvature of between approximately 80 to 160 inches and, more preferably, approximately 120 inches.

In addition, the distal sole surface 42 of the central wing 30 is radiused to improved the interaction between the sole 22 and the putting surface as a ball is stroked. More specifically, the central wing 30 includes a first end 44 adjacent to the striking face 14 and a free second end 46 extending away from the striking face 14. The second end 46 is contoured to enhance performance of the club head 10 by providing both concave and convex surfaces 48, 50. More particularly, the second end 46 of the central wing 30 has a radius of curvature as the central wing 30 extends rearwardly creating a convex surface 50. The radius of curvature for this convex surface 50 is preferably sufficient to release the second end from undesirable contact with the fringe surrounding a putting green.

With regard to the concave surface 48, it extends laterally across the central wing 30 along the convex surface 50 extending from front to back along the second end 46. The concave radius of curvature for this concave surface 48 is preferably sufficient to minimize undesirable contact of the second end 46 with the putting surface.

The radius of curvature of each of the convex and concave surfaces generally does not extend more than midway between the top surface and the sole.

In general, the specific weighting of the putter head optimizes performance. The combination of the toe and heel wings, as well as the weight members extending therefrom and the central wing, provide a tri-weighting system with extreme heel and toe weighting. For example, the wings and weight members allow the mass to be moved much further back and beyond the striking face. Thus, the center of gravity can be moved much further back than the typical "blade" or "mallet" putter. Further, the provision of a central wing extending rearwardly from the striking face moves the center of gravity rearwardly in a desirable manner, as well as providing a weight receiving recess so that a weight can be placed at the extreme end thereof or adjusted to fill the entire cavity above the horizontal plane if desired.

Not only does this design provide for extreme heel and toe weighting, but it locates large masses outside the striking face edges and on opposite sides of shaft connection. With this design a higher moment of inertia for club head twisting is created, reducing the effects of torque from an off-center putt. Thus the force of a ball struck at off-center point will be minimal compared to the force required to start the head twisting. That is, the force generated by striking a ball is minimal when compared to the weight displaced from the central striking surface as a result of the weighted wings which shift the weight of the putter head toward the heel and toe of the club. These weighted wings generate a substantial moment which compensates, and covers up, any undesirable moments generated when a golf ball is struck off center by an individual putting.

In addition to shifting mass toward the toe and heel of the putter head, mass is shifted upwardly above the horizontal center plane of the putter. As the horizontal central plane is generally designed to correspond to the center of a golf ball being struck by the present putter, the majority of putter head weight is concentrated above the center of the ball, causing the ball to immediately begin rolling upon impact as the higher weight encourages rolling of the golf ball in conjunction with the forward motion.

It will certainly be understood by those of ordinary skill in the art the dimensions of the putter head may be varied depending upon the particular swing characteristics desired for the putter head. For example, the wings may extend back and away from the center of gravity at various angles.

The improved accuracy is a result of the total head design features. The high density of the weight members adds substantial weight along the toe and heel wings so that a majority of the weight resides in the tips of the toe and heel wings. As discussed above, the higher positioning of the putter head mass relative to the horizontal center plane enhances forward rotation of a golf ball upon impact. The total head design features and the mass positioning produce a straighter, more reliable putt. When a ball is not struck squarely, the club will tend to 'twist' and the ball will generally not travel in a straight path. The club of the present invention has a higher moment of inertia in the torque or twist plane of the club head, helping to direct improperly struck golf balls toward a desired path. The heel and toe weighting creates a higher moment of inertia, reducing the effects of torque from an off-center putt. In fact, each weight member weighs more than a golf ball. This directly affects the accuracy of the shot and is better for performance.

While the preferred embodiments have been shown and described, it will be understood that there is no intent to limit the invention by such disclosure, but rather, is intended to cover all modifications and alternate constructions falling within the spirit and scope of the invention as defined in the appended claims.

The invention of claimed is:

1. A golf putter head, comprising:

a primary body member having a striking face with a toe end and a heel end, a top surface and sole;

the primary body member including a toe wing extending back and away from the toe end of the striking face at an oblique angle beyond the toe end;

the primary body member also including a heel wing extending back and away from the heel end of the striking at an oblique angle beyond the heel end;

a first weight member extending from the toe wing and a second weight member extending from the heel wing.

2. The golf putter head according to claim 1, wherein the primary body member further includes a central wing extending rearwardly from a center of the striking face between the heel end and the toe end, and the central wing includes a first end adjacent to the striking face and a free second end extending away from the striking face.

3. The golf putter head according to claim 2, wherein a third weight member extends from the second end of the central wing.

4. The golf putter head according to claim 3, wherein the first, second and third weight members are selectively coupled to the primary body member.

5. The golf putter head according to claim 2, wherein the first weight member and the second weight member are made from a material having a higher density than the primary body member.

6. The golf putter head according to claim 1, wherein the first and second weight members are selectively coupled to the primary body member.

7. The golf putter head according to claim 1, wherein the putter body includes a horizontal central plane, the horizontal central plane is considered to be a horizontal plane extending through the putter body and equal distance from both an uppermost surface of the upper surface of the primary body member and a lowermost surface of the sole, wherein the first and second weight members are coupled to the primary body member such that a majority of their mass is positioned above the horizontal center line.

8. The golf putter head according to claim 1, wherein the putter body includes a horizontal central plane, the horizontal central plane is considered to be a horizontal plane extending through the putter body and equal distance from both an uppermost surface of the upper surface of the primary body member and a lowermost surface of the sole, and a majority of their mass is positioned above the horizontal center line.

9. The golf putter head according to claim 6, wherein approximately at least 70% of the total putter head mass is positioned above the horizontal center plane.

10. The golf putter head according to claim 9, wherein between approximately 55% and approximately 75% of the total putter head mass is positioned above the horizontal center plane.

11. A golf putter head, comprising:

a primary body member having a striking face with a toe end and a heel end, a top surface and sole;

the primary body member including a toe wing extending back and away from the toe end of the striking face;

the primary body member also including a heel wing extending back and away from the heel end of the striking;

a first weight member extending from the toe wing and a second weight member extending from the heel wing;

the primary body member also includes a central wing extending rearwardly from a center of the striking face between the heel end and the toe end, and the central wing includes a first end adjacent to the striking face and a free second end extending away from the striking face; and wherein the sole adjacent the second end of the central wing is contoured with both concave and convex surfaces.

12. The golf putter head according to claim 11, wherein sole adjacent the second end of the central wing has a radius of curvature as the central wing extends rearwardly creating a convex surface.

13. The golf putter head according to claim 12, wherein the sole adjacent the second end of the central wing has a concave surface which extends laterally across the central wing along the convex surface.

14. A golf putter head, comprising:

a primary body member having a striking face with a toe end and a heel end, a top surface and sole;

the putter body further including a central wing extending rearwardly from a center of the striking face between the heel end and the toe end, wherein the central wing includes a first end adjacent to the striking face and a free second end extending away from the striking face, and the sole adjacent the second end is contoured with both a concave surface with a radius of curvature as viewed from a rear of the putter head and a convex surfaces with a radius of curvature as viewed in cross-section through said central wing from a toe end; the radius of curvature of each of the convex and the concave surfaces generally not extending more than midway between the top surface and the sole.

15. The golf putter head according to claim 14, wherein the second end of the central wing has a radius of curvature as the central wing extends rearwardly creating a convex surface.

16. The golf putter head according to claim 15, wherein the second end of the central wing has a concave surface which extends laterally across the central wing along the convex surface.

* * * * *